US007609992B2

(12) United States Patent
Kim

(10) Patent No.: US 7,609,992 B2
(45) Date of Patent: Oct. 27, 2009

(54) IMAGE FORMING APPARATUS WITH A POLLUTION CONTROL UNIT

(75) Inventor: Yu-man Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 44 days.

(21) Appl. No.: 11/506,923

(22) Filed: Aug. 21, 2006

(65) Prior Publication Data

US 2007/0147877 A1 Jun. 28, 2007

(30) Foreign Application Priority Data

Dec. 27, 2005 (KR) ..... 10-2005-0130866

(51) Int. Cl.
*G03G 15/16* (2006.01)

(52) U.S. Cl. ..... 399/101

(58) Field of Classification Search ..... 399/101
See application file for complete search history.

(56) References Cited

U.S. PATENT DOCUMENTS

| | | | | |
|---|---|---|---|---|
| 5,970,297 | A * | 10/1999 | Gross | 399/313 |
| 6,035,158 | A * | 3/2000 | Asakura et al. | 399/101 |
| 6,778,802 | B2 * | 8/2004 | Kabata et al. | 399/303 |
| 7,062,186 | B2 * | 6/2006 | Kyung | 399/66 |

FOREIGN PATENT DOCUMENTS

| | | | |
|---|---|---|---|
| JP | 01179979 | A * | 7/1989 |
| JP | 7-210011 | | 8/1995 |
| JP | 07271242 | A * | 10/1995 |
| JP | 10-104958 | | 4/1998 |
| JP | 10-260587 | | 9/1998 |
| JP | 2001-265095 | | 9/2001 |
| JP | 2002123094 | A * | 4/2002 |
| JP | 2004-109282 | | 4/2004 |
| JP | 2006259367 | A * | 9/2006 |
| KR | 94-4029 | | 2/1994 |
| KR | 10-0305164 | | 7/2001 |

* cited by examiner

*Primary Examiner*—Quana M Grainger
(74) *Attorney, Agent, or Firm*—Roylance, Abrams, Berdo & Goodman, L.L.P.

(57) ABSTRACT

An image forming apparatus that can prevent a transfer belt from being polluted by used developer on a belt cleaning member is disclosed. The apparatus includes at least one photoconductor on which a developer image is formed, a transfer belt, a belt cleaning member, and a first pollution control unit. The transfer belt transfers the developer image formed on the photoconductor to an image receiving medium, and the transfer belt is rotatably supported by a driving roller and a driven roller. The belt cleaning member cleans used developer remaining on the transfer belt after the developer image is transferred. The belt cleaning member is able to move into contact with the transfer belt or be separated from the transfer belt. The first pollution control unit is disposed on the driven roller, and prevents the used developer on the belt cleaning member from moving to the transfer belt due to electrical forces when the transfer belt passes by the vicinity of the belt cleaning member separated from the transfer belt. The first pollution control unit prevents the transfer belt from being polluted by the used developer on the belt cleaning member without requiring the belt cleaning member to be spaced apart from the transfer belt as much as required by conventional image forming apparatuses.

14 Claims, 3 Drawing Sheets

IMAGE FORMING APPARATUS WITH A POLLUTION CONTROL UNIT

CROSS-REFERENCE TO RELATED APPLICATION

This application claims the benefit under 35 U.S.C. § 119 (a) of Korean Patent Application No. 10-2005-130866, filed Dec. 27, 2005, in the Korean Intellectual Property Office, the entire disclosure of which is hereby incorporated by reference.

BACKGROUND OF THE INVENTION

1. Field of the Invention

The present invention relates to an image forming apparatus, such as a copier or a laser printer. More particularly, the present invention relates to an image forming apparatus having a transfer belt that conveys a developer image formed on a photoconductor to and transfers the developer image onto a recording medium.

2. Description of the Related Art

Color image forming apparatuses are typically classified as either a multi-path type apparatus or a single path type apparatus. A multi-path type apparatus rotates a single photoconductor several times to form a desired color image, and a single path type apparatus rotates a plurality of photoconductors one time to form a desired color image.

Multi-path type image forming apparatuses have both advantages and disadvantages. On the one hand, since a multi-path type image forming apparatus forms a required color image by revolving a single photoconductor several times, it produces color image more slowly than a single path type image forming apparatus. On the other hand, a multi-path type image forming apparatus uses a single photoconductor, and therefore has a reduced number of parts so that it has a simpler construction and is more compact.

FIG. 1 shows an example of a multi-path type color image forming apparatus.

As shown in FIG. 1, the multi-path type color image forming apparatus 1 has a transfer belt 20. The transfer belt 20 puts a plurality of single color developer images, for example, yellow, magenta, cyan, and black developer images, formed at predetermined time intervals on a photoconductor 10, together to form a primary transfer image, and then transfers the primary transfer image to an image receiving medium P.

To enhance transfer efficiency, the transfer belt 20 is generally made of a polymer having a volume resistance of $10^8$ Ω·cm~$10^{11}$ Ω·cm. A high resistance coating layer is formed on an outer surface of the transfer belt 20 to prevent image spreading. The high resistance coating layer has a volume resistance higher than $10^8$ Ω·cm~$10^{11}$ Ω·cm.

The transfer belt 20 is supported by a driving roller 21 and a driven roller 23 so that it rotates along an endless loop. The driving roller 21 is formed of a metal roller 21*a*, which may be made of a metal such as aluminum. To drive the transfer belt 20 stably, a rubber layer 21*b* is formed on the outer surface of the metal roller 21*a*. The driving roller 21 is grounded by a ground 22 so as to discharge an electric potential which is generated by rubbing of the rubber layer 21*b* against the transfer belt 20. The electric potential on the driving roller has a polarity opposite to that of used developer. The driven roller 23 is formed of a metal roller 23*a*, which may be made of a metal such as aluminum, so that a belt cleaning member 28 may firmly contact the transfer belt 20.

An electrostatic latent image which corresponds to a first color, such as yellow, is formed on the surface of the photoconductor 10 by laser beams emitted from a laser scanning unit 19 according to an image signal. The electrostatic latent image is developed into a yellow developer image by a corresponding yellow developing unit 11.

The yellow developer image formed on the surface of the photoconductor 10 is transferred to the transfer belt 20 with pressure and a first transfer-bias voltage which are applied to the transfer belt 20 by a first transfer roller 25.

In the same manner, the remaining color developer images, such as magenta, cyan and black developer images, are individually formed on the surface of the photoconductor 10 by corresponding magenta, cyan and black developing units 13, 15 and 17, and then transferred and superimposed on the yellow developer image on the transfer belt 20 by the pressure and the first transfer-bias voltage of the first transfer roller 25. As a result, a primary transfer image in which the yellow, magenta, cyan and black developer image are superimposed is formed on the transfer belt 20.

The primary transfer image formed on the transfer belt 20 is then transferred to an image receiving medium P with pressure and a second transfer-bias voltage which are applied to the image receiving medium P by a second transfer roller 27. As a result, a secondary transfer image is formed on the image receiving medium P.

After the primary transfer image is transferred to the image receiving medium P, used developer remaining on the transfer belt 20 is cleaned and removed by a belt cleaning member 28. The belt cleaning member 28 is disposed below the driven roller 23 and is placed into contact with or separated from the transfer belt 20 by an actuating member (not shown). The belt cleaning member 28 may be formed of a blade made of, for example, urethane rubber and may have a thickness of approximately 2 mm.

The secondary transfer image transferred to the image receiving medium P is fused onto the image receiving medium P by heat from a heating roller (not shown) and pressure from a compression roller (not shown) of a fusing unit (not shown) while passing by the fusing unit. The image receiving medium P with the fused secondary transfer image is discharged from the image forming apparatus by a discharge roller (not shown) of a discharging unit (not shown).

With the conventional image forming apparatus 1 constructed as described above, a problem occurs in that friction between the image receiving medium P and the transfer belt 20, friction between the transfer belt 20 and the driving roller 21 or the driven roller 23, and the like, generate an electric potential on the transfer belt 20. The electric potential has a polarity opposite to that of the used developer. Thus, when the transfer belt 20 with a transfer image passes by the belt cleaning member 28, used developer on the belt cleaning member 28 is transferred back to the transfer belt 20 due to the opposite polarities, thereby deteriorating the quality of the primary transfer image.

To address this problem, the transfer belt 20 is preferably configured to have a low electric resistance so that the transfer belt 20 is not charged with an electrical potential with a polarity opposite to that of the used developer even though it is rubbed against the driving roller 21 and the driven roller 23. Since the transfer belt 20 is made of a polymer having a high electric resistance layer coated on an outer surface thereof to prevent image spreading during transferring, however, there is a limit to reducing the electric resistance of the transfer belt 20 so as to prevent the pollution by the used developer on the belt cleaning member 28.

Accordingly, to prevent pollution by the used developer on the belt cleaning member 28, the conventional image forming apparatus 1 is configured so that the belt cleaning member 28 contacts the transfer belt 20 at an angle of less than 90° as shown in FIG. 1, or at an angle of approximately 90°. When the belt cleaning member 28 is designed to contact the transfer belt 20 at an angle of less than 90°, and the belt cleaning member 28 is separated from the transfer belt 20, it is positioned almost parallel to the transfer belt 20 so that used developer cleaned by and adhered to the belt cleaning member 28 can fall into and be completely collected by a storage container (not shown). Also, when the belt cleaning member 28 contacts the transfer belt 20 at an angle of approximately 90°, the belt cleaning member 28 is separated from the transfer belt 20 so that it is spaced apart from the transfer belt 20 with a sufficient distance d so that the used developer cleaned by and adhering to the belt cleaning member 28 is positioned sufficiently remote from the transfer belt 20 that it is not attracted to the transfer belt 20. These conditions, however, not only restrict freedom in design, but also increase the space required for the belt cleaning member 181, thereby imposing restrictions on the size of the apparatus.

Accordingly, there is a need for an improved image forming apparatus that prevents used developer from transferring from a belt cleaning member to a transfer belt.

SUMMARY OF THE INVENTION

An aspect of the present invention is to address at least the above problems and/or disadvantages and to provide at least the advantages described below. Accordingly, an aspect of the present invention is to provide an image forming apparatus that can prevent a transfer belt from being polluted by used developer on a belt cleaning member, while freely installing or arranging the belt cleaning member.

According to an aspect of an exemplary embodiment of the present invention, an image forming apparatus includes at least one photoconductor on which a developer image is formed, a transfer belt, a belt cleaning member, and a first pollution control unit. The transfer belt transfers the developer image formed on the photoconductor to an image receiving medium, and the transfer belt is rotatably supported by a driving roller and a driven roller. The belt cleaning member cleans used developer remaining on the transfer belt after the developer image is transferred. The belt cleaning member is able to move into contact with the transfer belt or be separated from the transfer belt. The first pollution control unit is disposed on the driven roller, and prevents the used developer on the belt cleaning member from moving to the transfer belt due to electrical forces when the transfer belt passes by the vicinity of the belt cleaning member separated from the transfer belt.

The driven roller may include a first conductive roller formed of metal, and the first pollution control part may include a first ground to ground the driven roller, or a first voltage applying part to apply voltage having the same polarity as that of the used developer to the driven roller.

Also, the driving roller may include a second conductive roller formed of metal, and a conductive rubber layer including a conductive substance formed on the second conductive roller, the conductive rubber layer being grounded by a second ground. At this time, the conductive rubber layer may have a volume resistance of $10^{11}$ Ω·cm or less.

The image forming apparatus may further include a second pollution control unit to prevent the used developer on the belt cleaning member from moving to the transfer belt due to electrical forces when the transfer belt passes by the vicinity of the belt cleaning member separated from the transfer belt, the second pollution control unit being disposed to the belt cleaning member. The second pollution control unit may include a second voltage applying part to apply voltage having a polarity opposite to that of the used developer to the belt cleaning member.

According to another aspect of an exemplary embodiment of the present invention, an image forming apparatus includes at least one photoconductor on which a developer image is formed, a transfer belt, and a belt cleaning member. The transfer belt transfers the developer image formed on the photoconductor to an image receiving medium, and the transfer belt is rotatably supported by a driving roller and a driven roller. The belt cleaning member cleans used developer remaining on the transfer belt after the developer image is transferred, and the belt cleaning member is able to be placed into contact with the transfer belt or be separated from the transfer belt. The driving roller includes a second conductive roller formed of metal; and a conductive rubber layer including conductive substance formed on the second conductive roller, the conductive rubber layer being grounded by a second ground.

The conductive rubber layer may have-a volume resistance of $10^{11}$ Ω·cm or less.

The image forming apparatus may further includes a first pollution control unit to prevent the used developer on the belt cleaning member from moving to the transfer belt due to electrical forces when the transfer belt passes by the vicinity of the belt cleaning member separated from the transfer belt. The first pollution control unit is disposed to the driven roller, and the driven roller may include a first conductive roller formed of metal. The first pollution control part may include a first ground to ground the driven roller, or a first voltage applying part to apply voltage having the same polarity as that of the used developer to the driven roller.

The image forming apparatus may further include a second pollution control unit to prevent the used developer on the belt cleaning member from moving to the transfer belt due to electrical forces when the transfer belt passes by the vicinity of the belt cleaning member separated from the transfer belt. The second pollution control unit is disposed to the belt cleaning member. The second pollution control unit may include a second voltage applying part to apply voltage having a polarity opposite to that of the used developer to the belt cleaning member.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
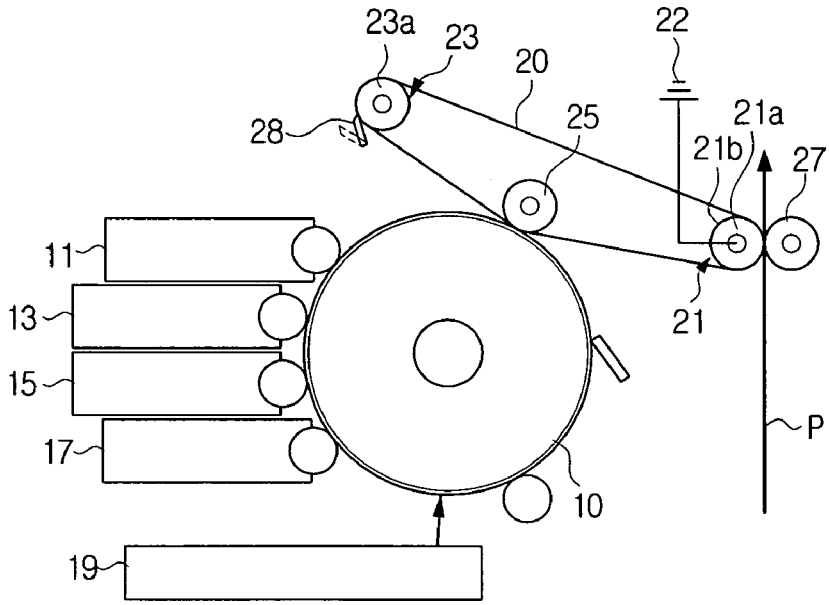
FIG. 1 (PRIOR ART)
FIG. 1 is a schematic view of a conventional image forming apparatus.
Figure 2:
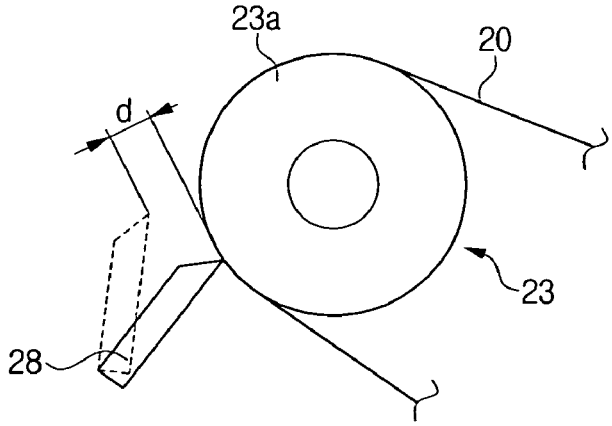
FIG. 2 (PRIOR ART)
FIG. 2 is an enlarged view of the belt cleaning member of the image forming apparatus of FIG. 1.
Figure 3:
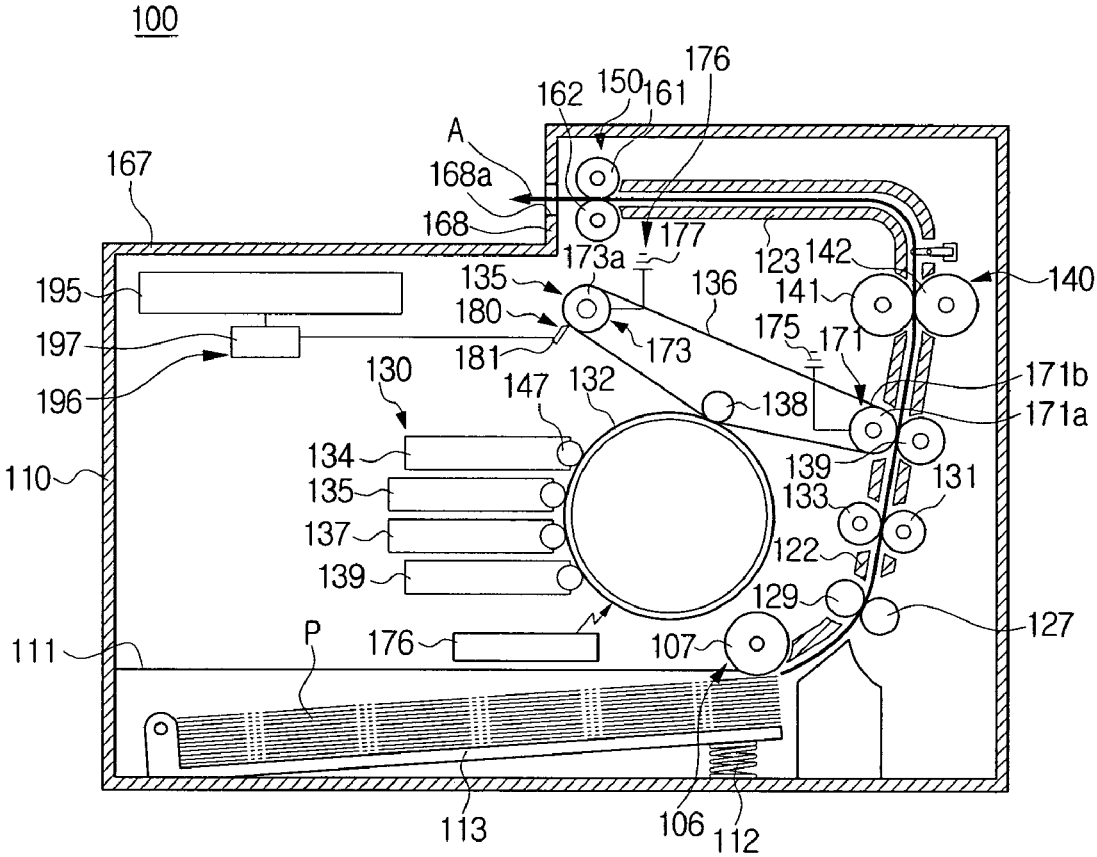
FIG. 3 is a schematic cross-sectional view of a laser printer according to an exemplary embodiment of the present invention.

FIG. 3 schematically shows an image forming apparatus according to an exemplary embodiment of the present invention.

The image forming apparatus according to the exemplary embodiment of the present invention may be a color laser printer 100 that prints and outputs data input from an external device, such as a computer. The present invention is not limited to a color laser printer 100, however, and may be used with other image forming apparatuses.

The color laser printer 100 includes a medium cassette 111, a feeding unit 106, an image forming unit 130, a transferring unit 135, a fusing unit 140, and a discharging unit 150.

The medium cassette 111 is detachably installed at a bottom portion of a main body frame 110, and has a pressing plate 113 supported by a resilient spring 112 to resiliently raise and lower an image receiving medium P such as a paper.

The feeding unit 106 is disposed above the medium cassette 111 to pick up and feed the image receiving medium P loaded in the medium cassette 111 one by one. The feeding unit 106 includes a medium sensor (not shown) to detect whether the image receiving medium P is loaded in the medium cassette 111, a first pickup roller 107 to pick up the image receiving medium P loaded in the medium cassette 111, and first and second conveying rollers 127 and 131 and first and second backup rollers 129 and 133 to convey the picked-up image receiving medium P along a conveying guide frame 122 that forms a medium conveying and discharging path A.

The image forming unit 130 is provided with a photoconductor 132, which is continuously rotated in one direction, for example, in a clockwise direction, by a photoconductor driving source (not shown) such as a motor.

A charger (not shown), a laser scanning unit LSU 176, four (for example, yellow, magenta, cyan, and black) developing units 134, 135, 137 and 139, and the transferring unit 135 are arranged at predetermined locations around an outer circumference of the photoconductor 132. The yellow, magenta, cyan and black developing units 134, 135, 137 and 139 contain developers of corresponding colors, that is, yellow, magenta, cyan and black developers, respectively.

The charger may be a scorotron charger which uniformly charges an outer surface of the photoconductor 132 to a predetermined electric potential. After the photoconductor is charged, the LSU 176 scans the outer surface of the photoconductor 132, by laser beams emitted from a laser diode according to an image signal input from an external device (such as a computer), and thereby forms an electrostatic latent image on the outer surface of the photoconductor 132.

Each of the yellow, magenta, cyan and black developing units 134, 135, 137 and 139 includes a developing roller 147, a developer supplying roller (not shown), and a developer layer regulating member or blade (not shown). The developing roller 147 applies a corresponding developer on a corresponding electrostatic latent image formed on the photoconductor 132 while being rotated with the photoconductor 132 so as to develop the electrostatic latent image into a developer image. The developing roller 147 is opposite to, and spaced apart from, the photoconductor 132 by a predetermined gap, for example, 0.2 mm. The developer supplying roller supplies the developer to the developer roller 147 using an electric potential difference from the developer roller 147. The developer layer regulating blade regulates the developer supplied to the developing roller 147 through the developer supplying roller such that a film formed on the developing roller 147 has a predetermined thickness.

The transferring unit 135 electrostatically transfers the developer image formed on the outer surface of the photoconductor 132 to the image receiving medium P, and includes a transfer belt 136, first and second transfer rollers 138 and 139, a belt cleaning unit 180, and first and second pollution control units 176 and 196.

The transfer belt 136 is made of a polymer having a volume resistance of $10^8$ Ω·cm~$10^{11}$ Ω·cm. To prevent image spreading, a high resistance coating layer is formed on an outer surface of the transfer belt 136. Preferably, the high resistance coating layer has a volume resistance higher than $10^8$ Ω·cm~$10^{11}$ Ω·cm.

The transfer belt 136 is rotatably supported by a driving roller 171 and a driven roller 173.

The driving roller 171 is formed of a second conductive roller 171*a* made of metal such as aluminum. To stably drive the transfer belt 136, a conductive rubber layer 171*b* is formed on an outer surface of the second conductive roller 171*a*.

The conductive rubber layer 171*b* is made of a rubber material such as urethane rubber in which carbon black is added as a conductive substance. Since the conductive rubber layer 171*b* includes a conductive substance having a high conductivity, even though the driving roller 171 is rubbed against the transfer belt 136 while driving the transfer belt 136, it does not electrify the transfer belt 136 with an electric potential having, a polarity opposite to that of used developer. To prevent friction electrification, the conductive rubber layer 171*b* is formed such that a volume resistance thereof is maintained in the range of less than $10^{11}$ Ω·cm.

Also, the conductive rubber layer 171*b* is grounded by a first ground 175 so that a primary transfer image formed on the transfer belt 136 can be secondarily transferred to the image receiving medium P by a second transfer-bias voltage which is applied to the image receiving medium P by the second transfer roller 139. The primary transfer image is formed by developer images firstly transferred to and superimposed on the transfer belt 136 from the outer surface of the photoconductor 132.

The driven roller 173 is formed of a first conductive roller 173*a* made of metal such as aluminum so that a belt cleaning member 181 of the belt cleaning unit 180 can firmly contact the transfer belt 136.

The first transfer roller 138 is connected to a first transfer-bias voltage applying unit (not shown) to apply a predetermined first transfer-bias voltage to the transfer belt 136.

The first transfer roller 138 applies the predetermined first transfer-voltage to the transfer belt 136 so that the developer images formed on the surface of the photoconductor 132 can be individually transferred and superimposed onto the transfer belt 136 to form the primary transfer image.

The second transfer roller 139 is connected to a second transfer-bias voltage applying unit (not shown) so as to apply a predetermined second transfer-bias voltage to the image receiving medium P.

The second transfer roller 139 applies the predetermined second transfer-voltage to the image receiving medium P so that the primary transfer image formed on the transfer belt 136 can be secondarily transferred to the image receiving medium P, which is conveyed to the transfer belt 136 by the feeding unit 106, to form a secondary transfer image thereon.

The first and the second transfer-bias voltage applying units are connected to a power supply 195.

The belt cleaning unit 180 cleans used developer remaining on the transfer belt 136 after the primary transfer image is secondarily transferred from the transfer belt 136 to the image receiving medium P, and includes a belt cleaning member 181, an actuating member 182, and a casing 183.

The belt cleaning member 181 is disposed below the driven roller 173 so that the actuating member 182 actuates the belt cleaning member 181 to place it into contact with or separate it from the transfer belt 136. The belt cleaning member 181 may be formed of a blade made of urethane rubber, for example. The blade may have a thickness of approximately 2 mm.

Figure 4:
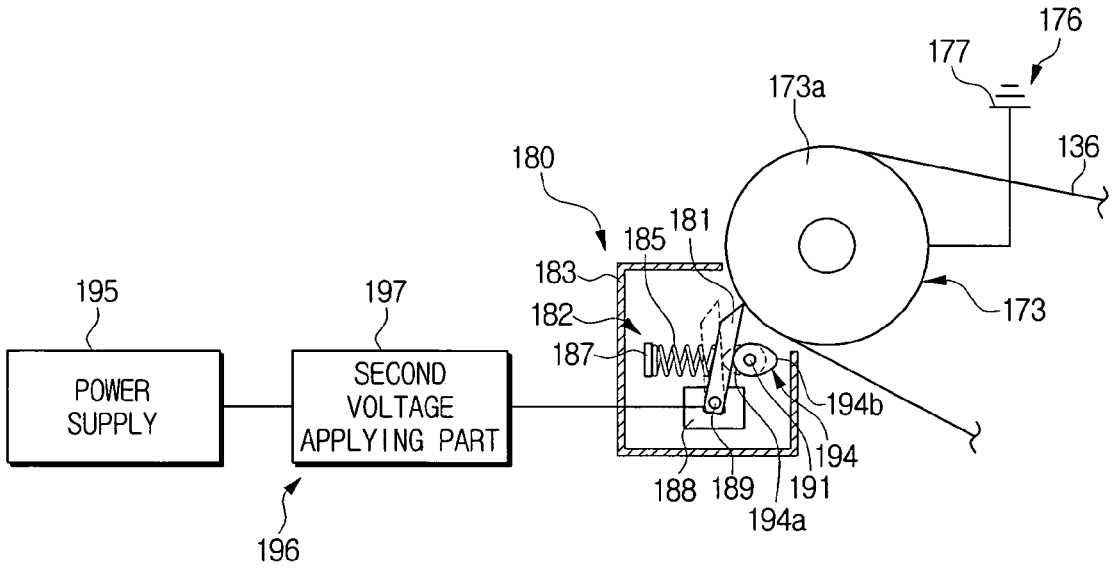
FIG. 4 is a partial view of first and second pollution control units of the laser printer of FIG. 3.

As shown in FIG. 4, the lower end of the belt cleaning member 181 is rotatably supported on a fixing shaft 189 of a fixing bracket 188, which is formed in the casing 183.

The casing 183 stores used developer that is cleaned and removed from the transfer belt 136 by the belt cleaning member 181.

The actuating member 182 actuates the belt cleaning member 181 to separate it from the transfer belt 136 when the developer images transferred onto the transfer belt 136 or the primary transfer image passes by the belt cleaning member 181, and actuates the belt cleaning member 181 to contact the transfer belt 136 when the used developer remaining on the transfer belt 136 after the primary transfer image is secondarily transferred to the image receiving medium P is removed.

For this, the actuating member 182 is provided with a cam 194 having a first cam surface 194*a* and a second cam surface 194*b* to contact a body of the belt cleaning member 181. The cam 194 is formed on a driving shaft 191 of a motor (not shown) installed outside the casing 183 so as to be driven by the motor. A cam spring 185 is disposed between the body of the belt cleaning member 181 and a supporting bracket 187 of the casing 183 so that the cam spring 185 presses the body of the belt cleaning member 181 into contact with the first cam surface 194*a* or the second cam surface 194*b*.

Accordingly, when the driving shaft 191 of the motor is rotated by 180° in one direction, for example, a clockwise direction from a position shown in solid lines in FIG. 4, the cam 194 moves to a position in which the second cam surface 194*b* contacts the body of the belt cleaning member 181, and the body of the belt cleaning member 181 pivots in a counterclockwise direction on the fixing shaft 189 against the cam spring 185. As a result, as shown in dotted lines in FIG. 4, the upper end of the belt cleaning member 181 is separated from the transfer belt 136.

In contrast, when the driving shaft 191 of the motor is rotated by 180° in the other direction, for example, the counterclockwise direction from the position rotated by 180° (shown in dotted lines in FIG. 4), the cam 194 moves to a position in which the first cam surface 194*a* contacts the body of the belt cleaning member 181, and the body of the belt cleaning member 181 pivots in the clockwise direction on the fixing shaft 189 by the elastic force of the cam spring 185 and returns to the original position. As a result, as shown in solid lines in FIG. 4, the upper end of the belt cleaning member 181 contacts the transfer belt 136.

The first pollution control unit 176 is formed of a second ground 177 to ground the first conductive roller 173*a* of the driven roller 173. The second ground 177 discharges an electric potential having an polarity opposite to that of the used developer, which is generated by rubbing of the driven roller 173 against the transfer belt 136, thereby preventing the used developer on the belt cleaning member 181 from moving to the transfer belt 136 when the transfer belt 136 passes by the vicinity of the belt cleaning member 181 separated from the transfer belt 136.

Figure 5:
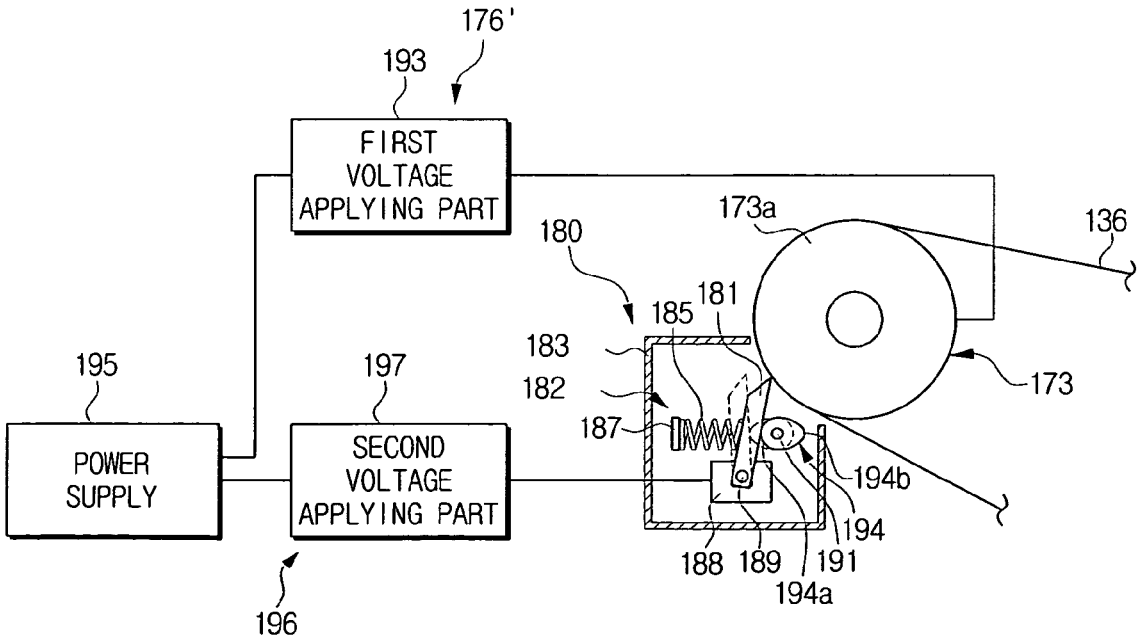
FIG. 5 is a partial view of a modified example of the first pollution control unit of the laser printer of FIG. 3.

Alternatively, as shown in FIG. 5, the first pollution control unit 176' can be formed of a first voltage applying part 193 to apply voltage having the same polarity as that of the used developer to the driven roller 173. The first voltage applying part 193 applies voltage having the same polarity as that of the used developer to the driven roller 173, thereby preventing the used developer on the belt cleaning member 181 from moving to the transfer belt 136 when the transfer belt 136 passes by the vicinity of the belt cleaning member 181 separated from the transfer belt 136. The first voltage applying part 193 is formed of a first power applying circuit (not shown), which is connected to the power supply 195. The first power applying circuit controls voltage from the power supply 195 to apply voltage having the same polarity as that of the used developer to the driven roller 173.

The second pollution control unit 196 is formed of a second voltage applying part 197 to apply voltage having a polarity opposite to that of the used developer to the fixing bracket 188 that fixes the belt cleaning member 181. The second voltage applying part 197 applies voltage having a polarity opposite to that of the used developer to the belt cleaning member 181 through the fixing bracket 188, thereby preventing the used developer on the belt cleaning member 181 from moving to the transfer belt 136 when the transfer belt 136 passes by the vicinity of the belt cleaning member 181 separated from the transfer belt 136. The second voltage applying part 197 is formed of a second power applying circuit (not shown), which is connected to the power supply 195. The second power applying circuit controls voltage from the power supply 195 to apply voltage having a polarity opposite to that of the used developer to the belt cleaning member 181 through the fixing bracket 188.

The fusing unit 140 fuses the secondary transfer image formed on the image receiving medium P by using heat and pressure so as to fix the secondary transfer image on the image receiving medium P. For this, the fusing unit 140 includes a heating roller 141 and a compression roller 142. The heating roller 141 heats the secondary transfer image on the image receiving medium P with high temperature to fuse the secondary transfer image onto the image receiving medium P. The compression roller 142 pressurizes the image receiving medium P to the heating roller 141.

The discharging unit 150 discharges the image receiving medium P to an output tray 167 after the secondary transfer image is fixed on the image receiving medium P by the fusing unit 140. The discharging unit 150 includes a discharging guide frame 123, a discharge roller 162, and a backup roller 161. The discharging guide frame 123 is disposed downstream of the fusing unit 140 so as to form the medium conveying and discharging path A. The discharge roller 162 and the backup roller 161 are rotatably fixed to the discharging guide frame 123 in the vicinity of a first discharging opening 168*a* that is formed at a vertical wall 168 of the main body frame 110 adjacent the output tray 167.

According to the exemplary embodiment of the present invention as described above, the color laser printer 100 includes the first pollution control unit 176 or 176' and the second pollution control unit 196 to prevent used developer on the belt cleaning member 181 from moving onto the transfer belt 136 by an electric force, and the driving roller 171 having the conductive rubber layer 171*b* coated thereon. Accordingly, the color laser printer 100 according to the exemplary embodiment of the present invention can prevent the transfer belt 136 from being polluted by used developer on the belt cleaning member 181, even though the belt cleaning member 181 is arranged so that the belt cleaning member 28 is spaced apart from the transfer belt 20 at a smaller distance than in a conventional image forming apparatus 1. That is, when the belt cleaning member 28 is separated from the transfer belt 20, it is closer than a distance d or may not be parallel to the transfer belt 20, unlike in the conventional image forming apparatus 1. Thus, the color laser printer 100 according to the exemplary embodiment of the present invention allows more freedom in the arrangement of the belt cleaning member 181, and the belt cleaning member 181 occupies less space so that the size of the laser printer 100 may be made smaller.

As previously noted, although the image forming apparatus according to the exemplary embodiment of the present invention has been described with respect to a multi-path type color laser printer 100 having a single photoconductor 132, it is not limited to this particular embodiment. For instance, the image forming apparatus according to the exemplary embodiment of the present invention is applicable to single path type color laser printers including a belt cleaning member to clean a transfer belt that transfers developer images from a plurality of photoconductors to an image receiving medium, using the same structures and principles.

The operation of the color laser printer 100 according to the exemplary embodiment of the present invention described above will now be described with reference to FIG. 3.

Initially, when a printing command is input through an external device (such as a computer) or a control panel (not shown), an image receiving medium P loaded in the medium cassette 111 is picked up by the pickup roller 107, and then conveyed toward the transferring unit 135 along the conveying guide frame 122 by the first conveying roller 127 and the second conveying roller 131.

While the image receiving medium P is moving toward the transferring unit 135, an electrostatic latent image for a first color, for example, yellow, is formed on the outer surface of the photoconductor 132 by laser beams emitted from the laser diode of the LSU 176 according to an image signal input from the external device. Yellow developer is adhered to the electrostatic latent image formed on the outer surface of the photoconductor 132 by the developing roller 147 of the yellow developing unit 134 to develop the electrostatic latent image into a visible, yellow developer image.

The yellow developer image formed on the surface of the photoconductor 132 is transferred to the transfer belt 136 of the transferring unit 135 by the pressure and first transfer-bias voltage applied by the first transfer roller 138.

After the yellow developer image is transferred to the transfer belt 136, used developer remaining on the outer surface of the photoconductor 132 is cleaned and removed from the photoconductor 132 by a photoconductor cleaning member (not shown). The photoconductor cleaning member is placed into contact with or is separated from the photoconductor 132 by an actuating member (not shown) with a cam or a solenoid.

As the transfer belt 136 is rotated, the yellow developer image transferred onto the transfer belt 136 passes by the belt cleaning member 181.

At this time, since the belt cleaning member 181 is separated from the transfer belt 136 by the cam 194, the yellow developer image on the transfer belt 136 is not cleaned.

Further, since the driven roller 173 disposed opposite to the belt cleaning member 181 is grounded by the second ground 177, or is applied with voltage having the same polarity as that of the used developer through the first voltage applying part 193, used developer adhered to the belt cleaning member 181 is prevented from moving to the transfer belt 136 by the electric force.

Also, when the belt cleaning member 181 is applied with voltage having a polarity opposite to that of the used developer by the second voltage applying part 197, used developer adhered to the belt cleaning member 181 is pulled toward the belt cleaning member 181 by the voltage applied thereto. As a result, the used developer is prevented from moving onto the transfer belt 136.

Next, an electrostatic latent image for a second color, for example, magenta, is formed on the outer surface of the photoconductor 132 by laser beams emitted from the laser diode of the LSU 176 according to an image signal input from the external device. The electrostatic latent image formed on the outer surface of the photoconductor 132 is developed into a magenta developer image by the developing roller 147 of the magenta developing unit 135. The magenta developer image formed on the outer surface of the photoconductor 132 is transferred and superimposed onto the yellow developer image on the transfer belt 136 by pressure and first transfer-bias voltage applied by the first transfer roller 138.

Subsequently, the next developer images, for example, cyan and black developer images, are individually formed on the photoconductor 132 in the same manner as described above, and then transferred and superimposed onto the yellow and the magenta developer images of the transfer belt 136. As a result, a primary transfer image is formed on the transfer belt 136.

When the image receiving medium P is conveyed to the transferring unit 135 along the conveying guide frame 122, the primary transfer image formed on the transfer belt 136 is secondarily transferred onto the image receiving medium P with pressure and second, transfer-bias voltage applied by the second transfer roller 139. As a result, a secondary transfer image is formed on the image receiving medium P.

At this time, since the driving roller 171 is formed of the conductive roller 171*a* with the conductive rubber layer 171*b* having the volume resistance of about $10^{11}$ Ω·cm or less, although in order to drive the transfer belt 136, the driving roller 171 contacts the transfer belt 136 and thus rubs against the transfer belt 136, the transfer belt 136 is not charged with an electric potential having a polarity opposite to that of the used developer. Also, although the transfer belt 136 is charged with an electric potential having a polarity opposite to that of the used developer, since the driving roller 171 is grounded by the second ground 175, the electric potential having a polarity opposite to that of the used developer is discharged through the second ground 175.

After the primary transfer image is transferred to the image receiving medium P, the actuating member 182 is actuated so that the cam 194 moves the belt cleaning member 181 into contact with the transfer belt 136. As a result, as the transfer belt 136 is rotated, used developer remaining on the transfer belt 136 is cleaned by the belt cleaning member 181 and then collected into the casing 183.

Meanwhile, the secondary transfer image transferred to the image receiving medium P is fused onto the image receiving medium P by heat from the heating roller 141 and pressure from the compression roller 142 while passing by the fusing unit 140.

The image receiving medium P onto which the secondary transfer image is fused is discharged towards the output tray 167 by the discharge roller 162 and the backup roller 161 of the discharging unit 160.

After that, if there are image signals of next pages to be printed, the above-described operations are performed with respect to the following image receiving medium P repeatedly until all of the desired images are printed.

According to the exemplary embodiment of the present invention as described above, an image forming apparatus includes a first pollution control unit and a second pollution control unit to prevent used developer on the belt cleaning member from moving to the transfer belt by an electric force, and/or a driving roller having a conductive rubber layer coated thereon. Accordingly, the image forming apparatus according to the exemplary embodiment of the present invention can prevent the transfer belt from being polluted by the used developer on the belt cleaning member, even though the belt cleaning member is arranged so as to position the belt cleaning member at a position closer to the transfer belt than in a conventional image forming apparatus. Also, the image forming apparatus e according to the exemplary embodiment of the present invention allows more freedom in the arrangement of the belt cleaning member, and the belt cleaning member occupies less space so that the size of the image forming apparatus may be made smaller.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

at least one photoconductor on which a developer image is formed;

a transfer belt for transferring the developer image formed on the photoconductor to an image receiving medium, the transfer belt being rotatably supported by a driving roller and a driven roller;

a belt cleaning member for cleaning used developer from the transfer belt after the developer image is transferred, the belt cleaning member selectively contacting the transfer belt; and a first pollution control unit for preventing used developer on the belt cleaning member from moving to the transfer belt by electrical forces when the transfer belt passes by the belt cleaning member separated from the transfer belt, the first pollution control unit being disposed to the driven roller;

wherein the driving roller comprises:

a second conductive roller formed of metal; and a conductive rubber layer including a conductive substance formed on the second conductive roller, the conductive rubber layer being grounded by a first ground.

2. The image forming apparatus of claim 1 wherein the driven roller comprises a first conductive roller formed of metal, and the first pollution control part comprises one of a first ground for grounding the driven roller and a first voltage applying part for applying voltage having the same polarity as that of the used developer to the driven roller.

3. The image forming apparatus of claim 1, wherein the conductive rubber layer has a volume resistance of $10^{11}$ Ω·cm or less.

4. The image forming apparatus of claim 1 further comprising a second pollution control unit for preventing used developer on the belt cleaning member from moving to the transfer belt due to electrical forces when the transfer belt passes by the belt cleaning member separated from the transfer belt, the second pollution control unit being disposed to the belt cleaning member.

5. An image forming apparatus comprising:

at least one photoconductor on which a developer image is formed;

a transfer belt for transferring the developer image formed on the photoconductor to an image receiving medium, the transfer belt being rotatably supported by a driving roller and a driven roller;

a belt cleaning member for cleaning used developer from the transfer belt after the developer image is transferred, the belt cleaning member selectively contacting the transfer belt;

a first pollution control unit for preventing used developer on the belt cleaning member from moving to the transfer belt by electrical forces when the transfer belt passes by the belt cleaning member separated from the transfer belt, the first pollution control unit being disposed to the driven roller; and a second pollution control unit for preventing used developer on the belt cleaning member from moving to the transfer belt due to electrical forces when the transfer belt passes by the belt cleaning member separated from the transfer belt, the second pollution control unit being disposed to the belt cleaning member;

wherein the second pollution control unit comprises a second voltage applying part for applying voltage having a polarity opposite to that of the used developer to the belt cleaning member.

6. An image forming apparatus comprising:

at least one photoconductor on which a developer image is formed;

a transfer belt for transferring the developer image formed on the photoconductor to a recording medium, the transfer belt being rotatably supported by a driving roller and a driven roller; and a belt cleaning member for cleaning used developer from the transfer belt after the developer image is transferred, the belt cleaning member selectively contacting the transfer belt; and a first pollution control unit for preventing used developer on the belt cleaning member from moving to the transfer belt due to electrical forces whenever the transfer belt passes by the belt cleaning member separated from the transfer belt, the first pollution control unit being disposed to the driven roller;

wherein the driving roller comprises:

a second conductive roller formed of metal; and a conductive rubber layer including a conductive substance formed on the second conductive roller, the conductive rubber layer being grounded by a first ground;

wherein the conductive rubber layer has a volume resistance of $10^{11}$ Ω·cm or less.

7. The image forming apparatus of claim 6, wherein the driven roller comprises a first conductive roller formed of metal.

8. The image forming apparatus of claim 7, wherein the first pollution control part comprises one of a second ground for grounding the driven roller and a first voltage applying part for applying voltage having the same polarity as that of the used developer to the driven roller.

9. An image forming apparatus comprising:

at least one photoconductor on which a developer image is formed;

a transfer belt for transferring the developer image formed on the photoconductor to a recording medium, the transfer belt being rotatably supported by a driving roller and a driven roller; and a belt cleaning member for cleaning used developer from the transfer belt after the developer image is transferred, the belt cleaning member selectively contacting the transfer belt;

a first pollution control unit for preventing used developer on the belt cleaning member from moving to the transfer belt due to electrical forces whenever the transfer belt passes by the belt cleaning member separated from the transfer belt, the first pollution control unit being disposed on to the driven roller; and a second pollution control unit for preventing used developer on the belt cleaning member from moving to the transfer belt due to electrical forces when the transfer belt passes by the belt cleaning member separated from the transfer belt, the second pollution control unit being disposed to the belt cleaning member;

wherein the driving roller comprises;

a second conductive roller formed of metal; and a conductive rubber layer including a conductive substance formed on the second conductive roller, the conductive rubber layer being grounded by a first ground.

10. The image forming apparatus of claim 9, wherein the second pollution control unit comprises a second voltage applying part for applying voltage having a polarity opposite to that of the used developer to the belt cleaning member.

11. An image forming apparatus comprising:

at least one photoconductor for forming a developer image;

a transfer belt for transferring the developer image from the photoconductor to a recording medium, the transfer belt being rotatably supported by a driving roller and a driven roller;

a belt cleaning member for cleaning used developer from the transfer belt after the developer image is transferred, the belt cleaning member selectively contacting the transfer belt; and means for preventing used developer on the belt cleaning member from moving to the transfer belt by electrical forces when the belt cleaning member is separated from the transfer belt;

wherein the driven roller is conductive, and the preventing means comprises a first voltage applying part for applying voltage having the same polarity as that of the used developer to the driven roller.

12. The image forming apparatus of claim 11, wherein the preventing means further comprises a second pollution control unit for preventing used developer on the belt cleaning member from moving to the transfer belt due to electrical forces when the transfer belt passes by the belt cleaning member separated from the transfer belt, the second pollution control unit being disposed to the belt cleaning member.

13. The image forming apparatus of claim 12, wherein the second pollution control unit comprises a second voltage applying part for applying voltage having a polarity opposite to that of the used developer to the belt cleaning member.

14. The image forming apparatus of claim 11, wherein the driving roller comprises:

a second conductive roller; and a conductive rubber layer including a conductive substance disposed on the second conductive roller, the conductive rubber layer being grounded by a second ground.

* * * * *

UNITED STATES PATENT AND TRADEMARK OFFICE

CERTIFICATE OF CORRECTION

PATENT NO. : 7,609,992 B2
APPLICATION NO. : 11/506923
DATED : October 27, 2009
INVENTOR(S) : Yu-man Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 83 days.

Signed and Sealed this

Twelfth Day of October, 2010

David J. Kappos

David J. Kappos
*Director of the United States Patent and Trademark Office*